US009494369B2

(12) United States Patent
Denoual et al.

(10) Patent No.: US 9,494,369 B2
(45) Date of Patent: Nov. 15, 2016

(54) HEAT EXCHANGER

(75) Inventors: Christophe Denoual, Noyen sur Sarthe (FR); Jimmy Lemee, St Jean d'Asse (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 251 days.

(21) Appl. No.: 13/392,608

(22) PCT Filed: Aug. 31, 2010

(86) PCT No.: PCT/EP2010/062699
§ 371 (c)(1),
(2), (4) Date: Jun. 11, 2012

(87) PCT Pub. No.: WO2011/023825
PCT Pub. Date: Mar. 3, 2011

(65) Prior Publication Data

US 2012/0247145 A1 Oct. 4, 2012

(30) Foreign Application Priority Data

Aug. 31, 2009 (FR) ..... 09 04125

(51) Int. Cl.
*F28D 9/00* (2006.01)
*F28F 9/00* (2006.01)

(52) U.S. Cl.
CPC ..... *F28D 9/0006* (2013.01); *F28D 9/0043* (2013.01); *F28F 9/001* (2013.01)

(58) Field of Classification Search
CPC ..... F28D 1/0333; F28D 1/0308; F28D 1/0316; F28D 1/0325; F28D 1/0375;
(Continued)

(56) References Cited

U.S. PATENT DOCUMENTS 662,130 A * 11/1900 Mulholland ..... 292/256.5
5,538,077 A * 7/1996 So ..... F28D 9/0043 165/109.1

(Continued)

FOREIGN PATENT DOCUMENTS

DE 102006033313 A1 3/2007
EP 0992756 A2 4/2000

(Continued)

OTHER PUBLICATIONS

English language abstract for DE 102006033313 extracted from the espacenet.com database on Jun. 12, 2012, 37 pages.

(Continued)

*Primary Examiner* — Tho V Duong
*Assistant Examiner* — Raheena Rehman
(74) *Attorney, Agent, or Firm* — Howard & Howard Attorneys PLLC

(57) ABSTRACT

The invention relates to a heat exchanger for exchanging heat between a first (HP) and a second (BP) fluids. According to the invention, said exchanger comprises a plurality of modules (15,15*a*,15*b*,15*c*) respectively including an upper plate (17) and a lower plate (19) assembled so as to define, between said plates (17,19), an inner cavity (21) forming a first circulating channel for the first fluid (HP), wherein said exchanger further comprises a housing (3) in which said modules (15,15*a*,15*b*,15*c*) are assembled in order to form said exchanger while defining spaces (33) between said modules, said spaces forming second circulation channels for the second fluid (BP).

8 Claims, 2 Drawing Sheets

(58) Field of Classification Search
CPC ..... F28D 9/0043; F28D 9/0006; F28D 9/001
USPC ..... 165/153, 166, 167, 78, 72, 74, 75
See application file for complete search history.

(56) References Cited

U.S. PATENT DOCUMENTS

| | | | | |
|---|---|---|---|---|
| 5,896,916 | A * | 4/1999 | Baechner et al. | 165/78 |
| 6,250,380 | B1 | 6/2001 | Strahle et al. | |
| 7,111,671 | B1 * | 9/2006 | Han | F28D 9/005 165/153 |
| 7,430,874 | B2 * | 10/2008 | Prince et al. | 62/199 |
| 7,703,506 | B2 | 4/2010 | Brost et al. | |
| 2003/0024696 | A1 * | 2/2003 | Haplau-Colan et al. | 165/153 |
| 2005/0150646 | A1 * | 7/2005 | Calhoun et al. | 165/167 |
| 2008/0202735 | A1 | 8/2008 | Geskes et al. | |
| 2008/0251242 | A1 * | 10/2008 | Irmler et al. | 165/164 |
| 2009/0126911 | A1 * | 5/2009 | Shore et al. | 165/109.1 |

FOREIGN PATENT DOCUMENTS

| | | | |
|---|---|---|---|
| EP | 1586845 | A1 | 10/2005 |
| FR | 2855605 | A1 | 12/2004 |
| FR | 2924490 | A1 | 6/2009 |
| GB | 356687 | A | 9/1931 |

OTHER PUBLICATIONS

English language abstract for EP 0992756 extracted from the espacenet.com database on Jun. 12, 2012, 15 pages.
English language abstract for EP 1586845 extracted from the espacenet.com database on Jun. 12, 2012, 13 pages.
English language abstract and translation for FR 2855605 extracted from the espacenet.com database on Jun. 12, 2012, 22 pages.
English language abstract and translation for FR 2924490 extracted from the espacenet.com database on Jun. 12, 2012, 37 pages.
International Search Report for Application No. PCT/EP2010/062699 dated Sep. 27, 2010, 10 pages.

* cited by examiner

Fig.1
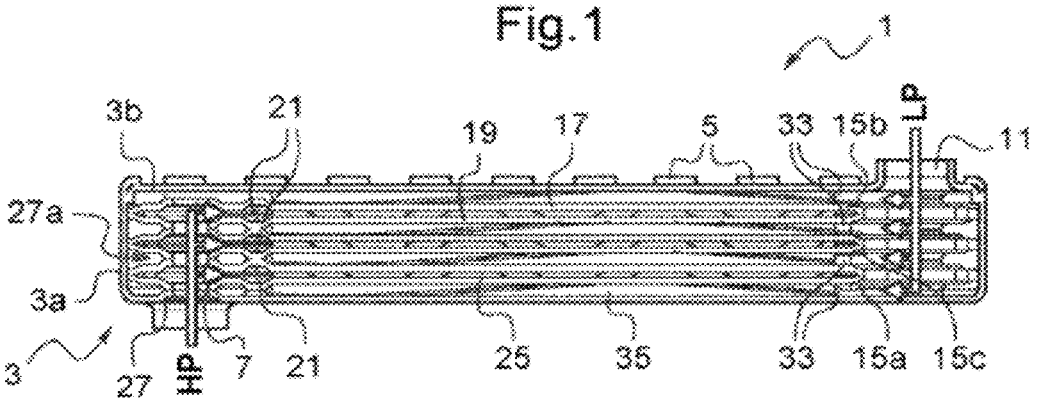
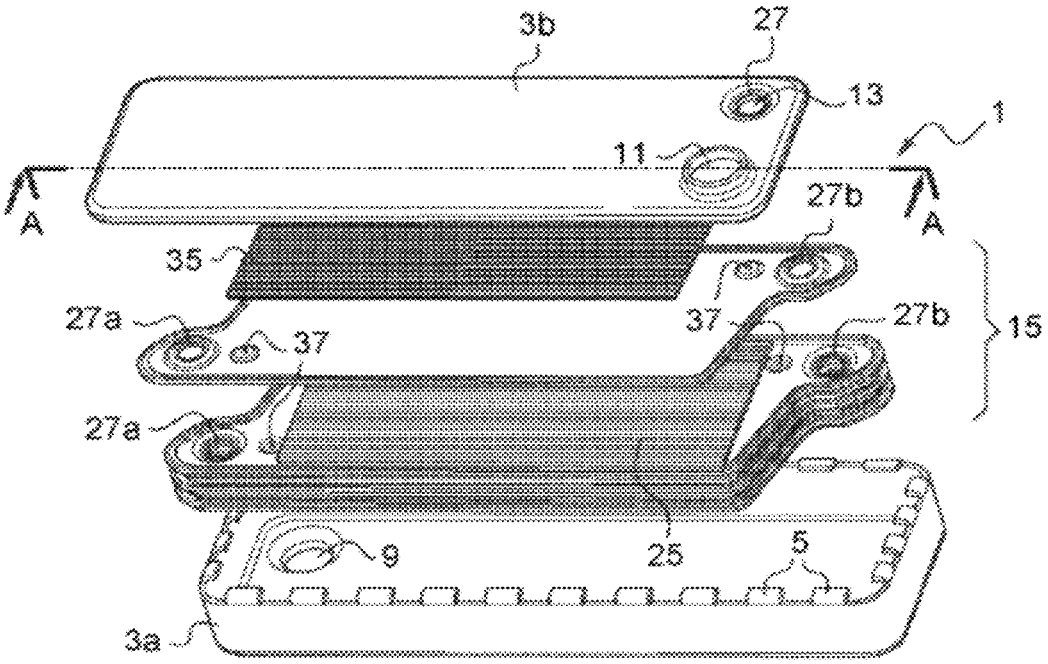
Fig.2

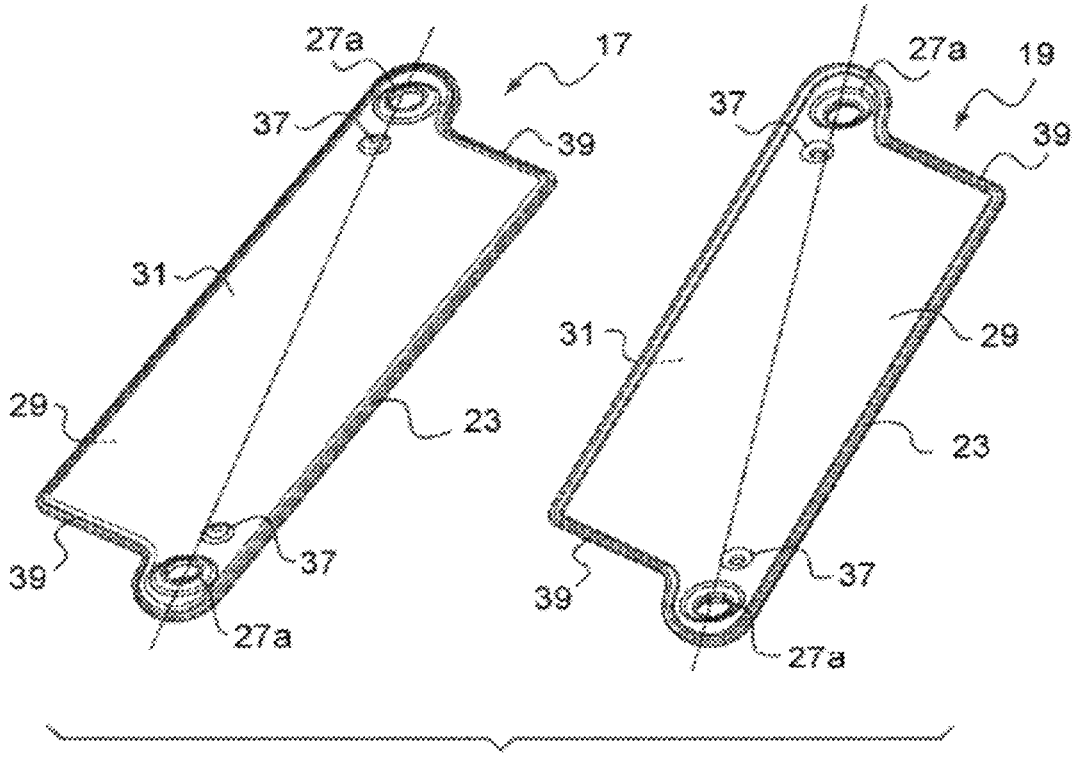
Fig.3
Fig.4
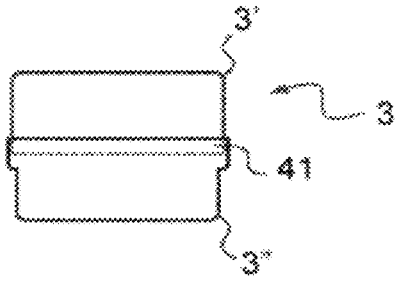

HEAT EXCHANGER

RELATED APPLICATIONS

This application claims priority to and all the advantages of International Patent Application No. PCT/EP2010/062699, filed on Aug. 31, 2010, which claims priority to French Patent Application No. FR 09/04125, filed on Aug. 31, 2009.

The invention relates to a heat exchanger particularly for an automotive vehicle, such as an internal exchanger in an air conditioning system.

Heat exchangers for automotive vehicles, which are constituted by a bundle of tubes which are disposed in parallel over one or more rows and are intended for circulation of a heat-carrying fluid, are currently known.

Heat exchangers comprising a plurality of plates placed one on top of the other and configured to define circulation channels for fluids for heat exchange are also known.

However, such exchangers contain a large number of components, in particular to ensure leak tightness and assembly, which can likewise prove to be long and expensive. In addition, the structure of such an exchanger must ensure leak tightness between each of the fluid circulation channels, but also between these channels and the environment surrounding the exchanger. This imposes a structure and brazing lines which complicates the production and assembly of such an exchanger.

The object of the invention is therefore to alleviate these drawbacks of the prior art by proposing a less costly heat exchanger based on a simple structure having a reduced number of components, whereby the overall size can be reduced and the assembly of such an exchanger made easier, at the same time as its performance is optimized.

For this purpose, the subject of the invention is a heat exchanger between a first and a second fluid, characterized in that it comprises a housing inside which is disposed a plurality of modules comprising respectively an upper plate and a lower plate assembled so as to define between said plates an inner cavity forming a first circulation channel for the first fluid, and in that at least one second circulation channel for the second fluid is delimited by the housing and a space between said modules.

Such a heat exchanger having a simple structure allows the number of components to be reduced, while guaranteeing good performance of the exchanger.

Said exchanger can additionally contain one or more of the following characteristics, taken separately or in combination:

- the upper and lower plates of a module respectively have at least one connecting portion cooperating with a related adjacent connecting portion of a contiguous module or of the housing, in order to assemble and seal said modules with respect to the housing (body and lid), and in that
- said connecting portions form bosses on the external surfaces of the upper and lower plates, said bosses extending respectively toward the related adjacent connecting portions, it being understood here that the upper and lower plates are symmetrical,
- said connecting portions form recesses on the internal surfaces facing the upper and lower plates forming a module,
- a predetermined number of connecting portions are aligned with a connecting portion of the housing having a feed-in/discharge orifice for the first fluid, and in that

- said plates respectively have two connecting portions disposed on either side of said plate on a common diagonal of said plate,
- said plates respectively have a parallelepipedal general shape, having two notches respectively made on two opposite edges of said plate,
- the housing has a feed-in orifice for the second fluid at the level of the discharge orifice for the first fluid, and a discharge orifice for the second fluid at the level of the feed-in orifice for the first fluid, for a counterflowing circulation of the first and second fluids,
- the housing contains a housing body in which said modules are stacked, said body being closed by a lid disposed above said modules and fixed to the body by means of latching lugs,
- the housing is constructed in the form of two joined half-housings,
- the heat exchanger contains fins disposed in the inner cavity which delimits the first circulation channel and/or in the space defined between said modules which delimits the second circulation channel.

The invention also relates to the use of a heat exchanger comprising any one of the characteristics set out above as an internal exchanger placed within an air conditioning loop for exchanging heat between a high pressure branch and a low pressure branch of said loop.

Finally, the invention also covers an air conditioning loop for an automotive vehicle, comprising a gas condenser or cooler, a pressure relief member, an evaporator and a compressor passed through, in this order, by a same coolant, said air conditioning loop comprising a high pressure branch, which starts at the outlet of the compressor and ends at the inlet of the pressure relief member, and a low pressure branch, which starts at the outlet of the pressure relief member and ends at the inlet of the compressor, characterized in that it comprises a heat exchanger such as described above, said first circulation channel being placed in the high pressure branch and said second circulation channel being placed in the low pressure branch.

The first fluid is a high pressure and high temperature fluid and the second fluid is a low pressure and low temperature fluid, the first fluid and the second fluid being identical, for example a refrigerant, such as R134A or carbon dioxide, which circulates within a closed circuit or air conditioning loop.

Other characteristics and advantages of the invention will become more clearly apparent from a reading of the following description, given as an illustrative and non-limiting example, and the appended drawings, which, if need be, will be able to be used to better define the invention, among which:

FIG. 1 is a sectional view (A-A visible in FIG. 2) of a heat exchanger according to the invention, FIG. 2 is a partially exploded view of the exchanger of FIG. 1, FIG. 3 represents plates forming a module of the exchanger of FIG. 1, and FIG. 4 is a construction variant of a housing of the exchanger of FIG. 1.

In these figures, the identical elements bear the same references.

FIG. 1 illustrates a heat exchanger 1, for example for an automotive vehicle, between a first fluid to be heated or cooled and a second fluid intended to absorb or surrender heat to the first fluid.

In the described embodiment, the first fluid HP (for High Pressure) is a fluid to be cooled at high pressure and high temperature and the second fluid LP (for Low Pressure) is a fluid at low pressure and low temperature intended to absorb the heat from the first fluid HP.

According to a first embodiment illustrated in FIGS. 1 and 2, the exchanger 1 contains a housing 3 containing a housing body 3*a* and a lid 3*b* fixed to the housing body 3*a*. For this purpose, the housing body 3*a* has a plurality of latching lugs 5 clamped on the lid 3*b* once the exchanger 1 is assembled. The body 3*a* is constructed by a deep drawing process. The plurality of latching lugs 5 skirts a circumferential rim. Opposite the latching lugs 5 in relation to the circumferential rim, the body 3*a* is closed by a base through which passes a feed-in orifice and a discharge orifice. The latching lugs 5, the circumferential rim and the base are unitary, in the sense that they are constructed from a same strip. The volume delimited by the circumferential rim and the base delimits a space which receives modules 15 which are stacked flat in this space.

Furthermore, the housing 3 has feed-in orifices for the first HP and second fluid LPs, and discharge orifices for the first HP and second fluid LPs. For example, the housing body 3*a* contains a feed-in orifice 7 for the first fluid HP and a discharge orifice 9 for the second fluid LP, and the lid 3*b* contains a feed-in orifice 11 for the second fluid LP and a discharge orifice 13 for the first fluid HP.

The feed-in 7 and discharge 13 orifices for the first fluid HP are connected in a leak-tight manner to a feed circuit (not represented) for the first fluid HP. Similarly, the feed-in 11 and discharge 9 orifices for the second fluid LP are connected in a leak-tight manner to a feed circuit (not represented) for the second fluid LP.

The housing 3, and more particularly the body 3*a* of the housing, accommodates a plurality of substantially identical modules 15 placed one on top of the other in the housing 3 and fixed in the housing 3, for example, by brazing.

Referring to the example of FIG. 1, three modules 15 are assembled in the housing 3:

a lower module 15*a* disposed at the bottom of the housing 3, an upper module 15*b* disposed on the top, and an intermediate module 15*c* between the lower 15*a* and upper 15*b* modules.

Of course, several intermediate modules 15*c* can be disposed between the lower 15*a* and upper 15*b* modules.

A module 15 contains an upper plate 17 and a lower plate 19, represented in greater detail in FIG. 3. The upper 17 and lower 19 plates are, for example, metal plates of substantially parallelepipedal general shape, which have a small thickness within the range 0.5 to 1.5 mm. At the angle of the small side (hereinafter the edge 39) and the large side of the parallelepipedal shape of the plates a protuberance is present, which protuberance extends in the same plane as the plate. This protuberance has a rounded contour and supports connecting portions 27*a* and 27*b* (at each end but in the diagonal of the plate). Beside this protuberance and over the rest of the small side or edge 39, it can be seen that the contour of the plate is inclined in the direction of the orifices placed on the opposite edge. This constitutes a notch, the function of which is to distribute the fluid into the spaces between the modules 15. When the lower 15*a*, upper 15*b* and intermediate 15*c* modules are accommodated in the body 3*a*, the inclined contours delimit, with the internal wall of the body 3*a* and the lid 3*b*, an intake chamber dedicated to the low pressure fluid LP. The existence of the inclined contour allows a sufficient volume to be freed for the feed-in orifice 11 not to be obstructed by the upper module 15*b*.

These upper 17 and lower 19 plates are joined together, defining between them an inner cavity 21 (FIG. 1). The contour 23 of the upper 17 and lower 19 plates (FIG. 3) can thus be raised in relation to the inside of the plate concerned. The raised contours 23 of two upper 17 and lower 19 plates are then joined together in such a way as to define the inner cavity 21 (FIG. 1).

Alternatively, only one of the two plates (lower or upper) of a same module can contain a raised contour, whereby the inner cavity 21 can be delimited.

This inner cavity 21 forms a first circulation channel of the first fluid HP. In this example comprising three modules 15, the exchanger 1 therefore contains three first channels. The first channels thus formed are mutually parallel and have a height, for example, of 1 to 1.5 mm.

Fins 25 can be disposed in these first channels in order to improve the heat exchange. These fins are in the form of a concertinaed tubulator plate.

In addition, the exchanger 1 is assembled by means of connecting portions on the housing 3 and on the modules 15. These connecting portions allow the modules 15 to be joined together with one another and with the housing 3 by cooperating with related adjacent connecting portions of a neighboring module 15 or of the housing 3.

More precisely, the bottom of the housing body 3*a* in contact with the lower module 15*a* has at least one connecting portion 27 (FIG. 1), the lid 3*b* in contact with the upper module 15*b* likewise has at least one connecting portion 27 (FIG. 2), and each module 15 has at least one connecting portion 27, more precisely each upper plate 17 and each lower plate 19 contains at least one connecting portion 27*a* and 27*b* respectively placed at each end of the plate, at the level of the protuberance present on the small side of this latter (FIG. 3).

In the example illustrated in FIGS. 1 and 2, the bottom of the housing body 3*a* and the lid 3*b* respectively contain a connecting portion 27. These connecting portions 27 respectively contain the feed-in orifice 7 of the first fluid HP and the discharge orifice 13 of the first fluid HP. The upper 17 and lower 19 plates in turn contain a first connecting portion 27*a* and a second connecting portion 27*b* (FIG. 3).

As can be seen in FIGS. 1 and 2, the first connecting portions 27*a* of the modules 15 are aligned with one another and with the connecting portion 27 of the housing body 3*a*. Similarly, the second connecting portions 27*b* of the modules 15 are aligned with one another and with the connecting portion 27 of the lid 3*b*.

Thus the connecting portion 27 of the housing body 3*a* cooperates with a related connecting portion 27*a* of the lower plate 19 of the lower module 15*a*, the connecting portions 27*a* and 27*b* of the upper plate 17 of the lower module 15*a* cooperate with the related connecting portions 27*a* and 27*b* of the lower plate 19 of the intermediate module 15*c*, the connecting portions 27*a* and 27*b* of the upper plate 17 of the intermediate module 15*c* cooperate with the related connecting portions 27*a* and 27*b* of the lower plate 19 of the upper module 15*b*, and a connecting portion 27*b* of the upper plate 17 of the upper module 15*b* cooperates with the related connecting portion 27 of the lid 3*b*.

In addition, the connecting portions 27*a* and 27*b* of the modules 15 likewise have orifices or holes for the passage of the first fluid HP.

Thus the orifices of the first connecting portions 27*a* communicate with one another and with the feed-in orifice 7 of the first fluid HP. A feed-in channel of the first fluid HP is thus defined.

Similarly, the orifices of the second connecting portions 27*b* communicate with one another and with the discharge orifice 13 of the first fluid HP. A discharge channel of the first fluid HP is thus defined.

Of course, the connecting portions 27, 27*a* and 27*b* cooperate with one another, by brazing for example, in a leak-tight manner in order to preclude any leak.

In addition, in order to promote the circulation of the first fluid HP in the first channels prior to its discharge, the first 27*a* and second 27*b* connecting portions of a plate 17, 19 can be disposed on either side of the upper 17 and lower 19 plates on a common diagonal of the plate concerned, shown in dotted representation in FIG. 3.

Furthermore, in order to improve the circulation of the first fluid HP, it can likewise be provided that the connecting portions 27*a* and 27*b* form recesses on the internal surfaces 29 facing the upper 17 and lower 19 plates.

Moreover, in the example illustrated in FIGS. 1 and 2, the connecting portion 27 of the housing body 3*a* forms a boss in relation to that surface of the housing body 3*a* which faces the lower module 15*a*. Similarly, the connecting portion 27 of the lid 3*b* forms a boss in relation to that surface of the lid 3*b* which faces the upper module 15*b*. And the connecting portions 27*a* and 27*b* of the modules 15 form bosses on the external surfaces 31 of the upper 17 and lower 19 plates.

The formed bosses extend respectively toward the related adjacent connecting portions 27, 27*a* or 27*b*.

Thus once the modules 15 are assembled in the housing 3, the bosses of the connecting portions 27, 27*a* and 27*b* allow spaces 33 to be defined between one or more consecutive modules 15*c* and between the lower 15*a* and upper 15*b* module respectively and the bottom of the housing body 3*a* and the lid 3*b* respectively.

These thus delimited spaces 33 form second, mutually parallel circulation channels of the second fluid LP, with a height which can range between 2 and 4 mm. In this example, the exchanger 1 has four second channels.

The second channels are therefore situated above and below the first channels in order to optimize the heat exchange between the two fluids HP/LP.

Thus with a reduced number of modules 15, here three modules 15, several first and second channels, here three first channels and four second channels, are obtained. The production costs and the overall size of the exchanger 1 are thus limited.

It is additionally possible to provide fins 35, or tubulator plates, in the spaces 33 in order to increase the heat exchange surface and the thermal performance.

Furthermore, the second channels are likewise parallel to the first channels, such that the two fluids HP and LP circulate in two parallel directions.

In this exchanger (FIGS. 1, 2), since the feed-in orifice 11 of the second fluid LP is at the level of the discharge orifice 13 of the first fluid HP and the discharge orifice 9 of the second fluid LP is at the level of the feed-in orifice 7 of the first fluid HP, the two fluids HP and LP circulate in counterflow. The counterflowing circulation allows the temperature deviations at the outlet of the exchanger 1 to be reduced and thus the performances of the exchanger 1 to be further optimized.

Of course, the circulation of the two fluids HP and LP can occur in the same direction, for a parallel flow circulation.

In order to improve the holding of the different modules 15, supplementary retaining portions 37 (FIGS. 2 and 3) can be provided on the upper 17 and lower 19 plates. For example, these supplementary portions 37 are disposed beside connecting portions 27*a* and/or 27*b* having the same features of recesses on the internal surfaces 29 and bosses on the external surfaces 31 of the upper 17 and lower 19 plates and having a smaller size than the connecting portions 27*a* and 27*b*. These supplementary retaining portions 37 have an additional function in that they preclude any displacements of the fins 35 present in the spaces 33.

Moreover, each upper 17 and lower 19 plate can have two notches respectively made on two opposite edges 39 of the plate 17 or 19 in order to improve the distribution of the second fluid LP in the different second channels.

The heat exchange performance is thus improved, while preserving a relatively simple shape of the upper 17 and lower 19 plates forming the modules 15.

Thus the assembly process for an exchanger 1 such as previously described comprises the following steps:

a brazing coating is deposited on the surfaces to be joined together, by way of example on the internal surfaces 29 of the upper 17 and lower 19 plates in order to form modules 15, and on the external surfaces 31 of the upper 17 and lower 19 plates and the internal surface of the housing 3 in order to connect the modules 15 to the housing 3, alternatively the brazing coating can be integral with the aluminum strip from which derive the upper 17 and lower 19 plates, the body 3*a* and the lid 3*b*, alternatively, upper plates 17 and lower plates 19 are introduced into the housing body 3*a*, with the insertion of a tubulator plate 35 or 25 between each upper/lower plate, above modules 15 formed by the upper 17 and lower 19 plates, the lid 3*b* is fixed onto the housing body 3*a* by the latching lugs 5 of the housing body 3*a* being clamped to the lid 3*b* so as to exert a pressure on the modules 15, and the whole which is formed by the housing 3 and the modules 15 is joined together by brazing.

The housing 3 ensures guidance and stacking of the upper 17 and lower 19 plates during this assembly process, which allows rapid and easily automatable assembly of the exchanger.

According to an alternative represented in FIG. 4, the exchanger 1 differs from the previously described first embodiment by the fact that the housing 3 is constructed in the form of two half-housings 3' and 3".

According to this second embodiment, each half-housing 3', 3" respectively in contact with the lower 15*a* and upper 15*b* modules contains a connecting portion 27. The modules 15 remain identical to the previously described first embodiment.

Regarding the assembly process, the two half-housings 3', 3" are fixed, for example by brazing, at the level of a joint 41 between the two half-housings 3', 3" so as to guarantee the leak-tightness of the housing 3.

Such a structure of the exchanger 1 thus allows the overall size of the exchanger 1 with thin upper 17 and lower 19 plates to be limited and permits a reduced number of components, while guaranteeing good heat exchange performance.

Furthermore, since the modules 15 containing the first channels are assembled in the housing 3 with spaces 33 delimiting second channels both above and below these first channels, the risks of leakage are minimized.

Finally, such an exchanger 1 is particularly suitable for use within an air conditioning loop for an automotive vehicle comprising a gas condenser or cooler, a pressure relief member, an evaporator and a compressor passed through, in this order, by a coolant. This air conditioning loop comprises a high pressure branch, which starts at the outlet of the compressor and ends at the inlet of the pressure relief member, and a low pressure branch, which starts at the outlet of the pressure relief member and ends at the inlet of the compressor. In this case, the exchanger according to the invention is used as an internal exchanger, that is to say an exchanger traversed by the coolant at high pressure and high temperature circulating in the first channels and traversed by the same coolant at low pressure and low temperature circulating in the second channels. The invention likewise relates to the use of the exchanger in this air conditioning loop and to the air conditioning loop incorporating such an exchanger.

The invention claimed is:

1. A heat exchanger between a first (HP) and a second (LP) fluid, said heat exchanger comprising:

a housing (3) including a housing body (3*a*) and a lid (3*b*) fixed to the housing body (3*a*) inside which is disposed a plurality of modules (15, 15*a*, 15*b*, 15*c*) comprising respectively an upper plate (17) and a lower plate (19) assembled so as to define between said plates (17, 19) an inner cavity (21) forming a first circulation channel for the first fluid (HP), wherein the upper (17) and lower (19) plates of a module (15, 15*a*, 15*b*, 15*c*) respectively have at least one connecting portion (27*a*, 27*b*) cooperating with a related adjacent connecting portion (27, 27*a*, 27*b*) of a contiguous module (15, 15*a*, 15*b*, 15*c*) or of the housing (3), said connecting portions (27*a*, 27*b*) form bosses on the external surfaces (31) of the upper (17) and lower (19) plates, said bosses extending respectively toward the related adjacent connecting portions (27, 27*a*, 27*b*), wherein the connecting portions (27*a*, 27*b*) form recesses on the internal surfaces (29) having the upper (17) and lower plates (19), and wherein the upper plate (17) and the lower plate (19) include retaining portions (37) disposed interior of the connecting portion (27, 27*a*, 27*b*) and configured to improve holding between the plurality of modules (15, 15*a*, 15*b*, 15*c*), said retaining portions (37) forming bosses on the external surfaces (31) of the upper (17) and lower (19) plates extending away from each other and recesses on the interior surfaces (29), and wherein one of said bosses on the external surfaces (31) of one of the upper (17) and lower (19) plates extends toward and contacts another one of said bosses on the external surfaces (31) of the other one of the upper (17) and lower (19) plates, wherein the bosses of the retaining portions (37) having a smaller size than the connecting portions (27, 27*a*, 27*b*);

wherein at least one second circulation channel for the second fluid (LP) is delimited by the housing (3) and a space (33) between said modules; and wherein the lid (3*b*) has a tubular discharge orifice (13) for the first fluid (HP) extending inwardly and a tubular feed-in orifice (11) for the second fluid (LP) at the level of the discharge orifice (13) for the first fluid (HP) extending outwardly, and the housing body (3*a*) has a tubular feed-in orifice (7) for the first fluid (HP) extending inwardly and a tubular discharge orifice (9) for the second fluid (LP) at a level of the feed-in orifice (7) for the first fluid (HP) extending outwardly, for a counter-flowing circulation of the first (HP) and second (LP) fluids.

2. The heat exchanger as claimed in claim 1, wherein:

a predetermined number of connecting portions (27*a*, 27*b*) are aligned with a connecting portion (27) of the housing, and wherein said aligned connecting portions (27*a*, 27*b*) respectively have an orifice, the set of said orifices communicating with one another in such a way as to define a feed-in/discharge channel for the first fluid (HP).

3. The heat exchanger as claimed in claim 1, wherein said plates (17, 19) respectively have two connecting portions (27*a*, 27*b*) disposed on either side of said plate (17, 19) on a common diagonal of said plate (17, 19).

4. The heat exchanger as claimed in claim 1, wherein said plates (17, 19) respectively have a parallelepipedal general shape, having two notches respectively made on two opposite edges (39) of said plate (17, 19).

5. The heat exchanger as claimed in claim 1, wherein said modules (15, 15*a*, 15*b*, 15*c*) are stacked, said body being closed by said lid (3*b*) disposed above said modules (15, 15*a*, 15*b*, 15*c*) and fixed to the body (3*a*) by means of latching lugs (5).

6. The heat exchanger as claimed in claim 1, wherein the housing (3) is constructed in the form of two joined half-housings (3', 3").

7. The heat exchanger as claimed in claim 1, further comprising fins (25, 35) disposed in the inner cavity (21) which delimits the first circulation channel and/or in the space (33) defined between said modules which delimits the second circulation channel.

8. The heat exchanger as claimed in claim 1, wherein:

a predetermined number of connecting portions (27*a*, 27*b*) are aligned with a connecting portion (27) of the housing, and wherein said aligned connecting portions (27*a*, 27*b*) respectively have an orifice, the set of said orifices communicating with one another in such a way as to define a feed-in/discharge channel for the first fluid (HP).

* * * * *